US010794625B2

(12) United States Patent
Nagamine et al.

(10) Patent No.: US 10,794,625 B2
(45) Date of Patent: Oct. 6, 2020

(54) COOLING APPARATUS AND COOLING METHOD

(71) Applicant: TOYOTA JIDOSHA KABUSHIKI KAISHA, Toyota-shi, Aichi-ken (JP)

(72) Inventors: Toshiki Nagamine, Toyota (JP); Naohide Hashimoto, Okazaki (JP); Fumiaki Aono, Ayase (JP); Yasuo Mizushima, Odawara (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 86 days.

(21) Appl. No.: 16/247,903

(22) Filed: Jan. 15, 2019

(65) Prior Publication Data

US 2019/0234674 A1 Aug. 1, 2019

(30) Foreign Application Priority Data

Jan. 26, 2018 (JP) ..... 2018-011662

(51) Int. Cl.

| | |
|---|---|
| ***F25D 3/12*** | (2006.01) |
| ***B01L 7/00*** | (2006.01) |
| ***F25D 17/08*** | (2006.01) |

(52) U.S. Cl.

CPC ..... *F25D 3/122* (2013.01); *B01L 7/00* (2013.01); *F25D 3/12* (2013.01); *F25D 17/08* (2013.01); *B01L 2200/0647* (2013.01); *B01L 2300/0832* (2013.01); *B01L 2300/1855* (2013.01); *B01L 2300/1894* (2013.01); *B01L 2400/0487* (2013.01)

(58) Field of Classification Search

CPC ..... F25D 3/12; F25D 3/00; F25D 3/02; F25D 3/125; F25D 17/08; F25B 23/00; F25B 19/005; F02B 29/04; F02B 29/0406; B01L 7/00; B01L 2400/0487; B01L 2300/0832; B01L 2300/1855; B01L 2300/1894; B01L 2200/0647; B01L 7/04

See application file for complete search history.

(56) References Cited

FOREIGN PATENT DOCUMENTS

| | | | |
|---|---|---|---|
| JP | 2009-216357 A | | 9/2009 |
| KR | 20140096908 A | * | 8/2014 |

* cited by examiner

*Primary Examiner* — Emmanuel E Duke
(74) *Attorney, Agent, or Firm* — Sughrue Mion, PLLC

(57) ABSTRACT

A first exemplary aspect is a cooling apparatus including: a heat insulator covering at least a part of a target object a supply pipe connected to a space between the heat insulator and the target object; a crusher configured to supply a sublimable coolant powder to the supply pipe; and an air cooler configured to jet gas to the supply pipe so that the coolant powder flows therethrough.

10 Claims, 6 Drawing Sheets

COOLING APPARATUS AND COOLING METHOD

CROSS REFERENCE TO RELATED APPLICATIONS

This application is based upon and claims the benefit of priority from Japanese patent application No. 2018-11662, filed on Jan. 26, 2018, the disclosure of which is incorporated herein in its entirety by reference.

BACKGROUND

The present disclosure relates to a cooling apparatus and a cooling method.

Japanese Unexamined Patent Application Publication No. 2009-216357 discloses a thermostatic bath for keeping a test chamber at a predetermined temperature. The thermostatic bath disclosed in Japanese Unexamined Patent Application Publication No. 2009-216357 includes a heater and a refrigerator. The heater heats supply air supplied to the test chamber. The refrigerator cools the supply air.

SUMMARY

In Japanese Unexamined Patent Application Publication No. 2009-216357, a test specimen is cooled by changing the air temperature in the test chamber using the refrigerator. Therefore, when the test specimen is cooled in a short time, it is necessary to evenly cool and circulate the air in the bath. Thus, there is a problem that the volume of the bath becomes larger and the cost thereby increases.

A first exemplary aspect is a cooling apparatus including: a heat insulator covering at least a part of a target object; a supply pipe connected to a space between the heat insulator and the target object; a coolant supply unit configured to supply a sublimable coolant powder to the supply pipe; and a first gas jetting unit configured to jet gas to the supply pipe so that the coolant powder flows through the supply pipe.

The above cooling apparatus may further includes a second gas jetting unit configured to jet gas so as to diffuse the coolant powder from the supply pipe.

In the above cooling apparatus, the space and the supply pipe may be connected through a freezing box, and the second gas jetting unit may cool gas to be jetted into the freezing box.

In the above cooling apparatus, the first air jetting unit may cool dry air to be jetted into the supply pipe.

In the above cooling apparatus, the coolant supply unit may crush a coolant into powder and supply the coolant powder to the supply pipe.

In the above cooling apparatus, the heat insulator may be a flexible heat insulation sheet.

In the above cooling apparatus, a spacer may be disposed between the heat insulator and the target object.

In the above cooling apparatus, a metal plate may be disposed on a side of the target object where the heat insulator is located so that the coolant powder flows through a space between the metal plate and the target object.

In the above cooling apparatus, the supply pipe may be a heat insulation hose.

Another exemplary aspect is a cooling method including: supplying a sublimable coolant powder to a supply pipe connected to a space between a heat insulator and a target object; jetting gas into the supply pipe so that the coolant powder flows through the supply pipe; cooling the target object by making the coolant powder flow through the space; and discharging the gas that has flowed through the space.

According to the present aspects, it is possible to provide a cooling apparatus and a method capable of cooling the target object that saves space and reduces cost.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Specific embodiments to which the present disclosure is applied will be explained hereinafter in detail with reference to the drawings. However, the present disclosure is not limited to the embodiments shown below. Further, for clarifying the explanation, the following descriptions and the drawings are simplified as appropriate.

First Embodiment

Figure 1:
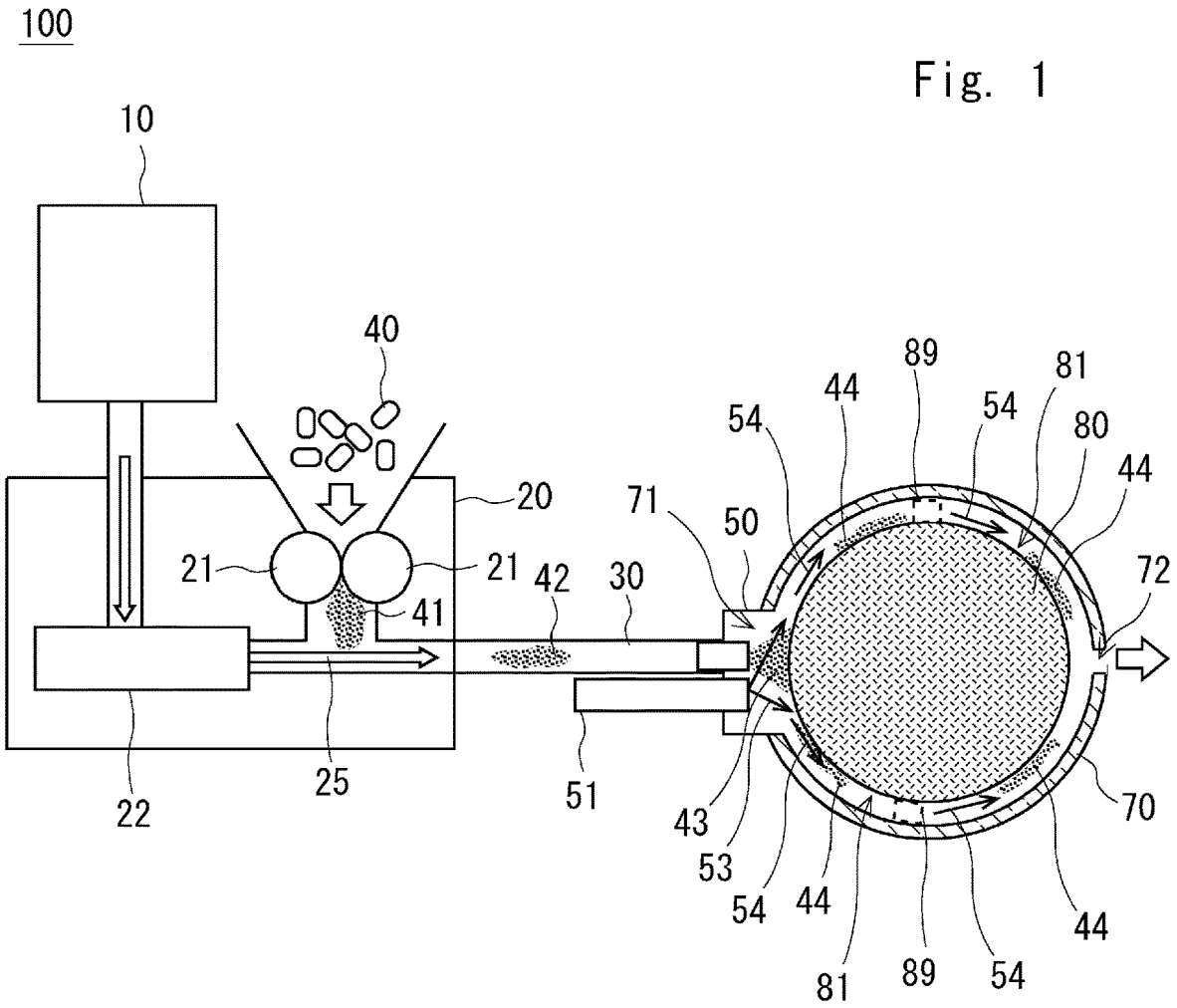
FIG. 1 is a schematic diagram showing a configuration of a cooling apparatus according to a first embodiment.

A cooling apparatus according to this embodiment is described with reference to FIG. 1. FIG. 1 is a schematic diagram showing a configuration of a cooling apparatus 100 for cooling a target object 80. The cooling apparatus 100 includes a compressed gas supply device 10, a supply device 20, a supply pipe 30, a freezing box 50, an air cooler 51, and a heat insulator 70. The cooling apparatus 100 uses a latent heat of sublimation of a sublimable coolant powder to cool the target object 80. The coolant powder is specifically blown onto the target object 80 by gas. The target object 80 is, for example, a transmission for automobiles and has a cylindrical shape.

The heat insulator 70 is, for example, a heat insulation sheet covering the target object 80. The heat insulator 70 covers the outer peripheral side surface of the cylindrical target object 80. A space 81 is formed between the heat insulator 70 and the target object 80. As described later, a coolant powder 44 flows through this space 81 so that the target object 80 can be cooled. The heat insulator 70 is preferably flexible. Since the shape of the heat insulator 70 can be changed flexibly, it can be changed according to the shape of the target object 80. Therefore, the size of the cooling apparatus 100 can be reduced.

In FIG. 1, the heat insulator 70 covers the entire target object 80. However, it may instead cover only a part of the target object 80. That is, the heat insulator 70 may cover at least a part of the target object 80. The heat insulator 70 includes an air supply port 71 and an exhaust port 72. The air supply port 71 is disposed on one end side of the target object 80, and the exhaust port 72 is disposed on the other end side of the target object 80. The air supply port 71 and the exhaust port 72 are connected to the space 81. Thus, the air supply port 71 and the exhaust port 72 are connected through the space 81. The exhaust port 72 is connected to the external space.

The supply pipe 30 is connected to the air supply port 71 through the freezing box 50. The air supply pipe 30 is, for example, a heat insulation hose. The air supply pipe 30 is preferably flexible. The air supply pipe 30 is connected to the air supply port 71 through the freezing box 50. Therefore, the air supply pipe 30 communicates with the space 81.

Gas is supplied to the air supply port 71 from the air supply pipe 30. Gas is sent from the air supply port 71 into the space 81 between the heat insulator 70 and the target object 80. Then, the gas sent into the space 81 is discharged from the exhaust port 72. Note that in FIG. 1, one air supply port 71 is provided in the heat insulator 70. However, two or more air supply ports 71 may be provided. Similarly, two or more exhaust ports 72 may be provided in the heat insulator 70. A size of the space 81 is preferably about 10 to 100 mm.

Note that in FIG. 1, an opening is provided in the insulator 70 to form the air supply port 71 and the exhaust port 72. However, the opening may not be provided in the insulator 70. For example, gas may be supplied or discharged from a space between the end of the insulator 70 and the target object 80. That is, the supply pipe 30 can be connected to the end of the heat insulator 70 so as to supply gas to the space 81 therefrom. Similarly, gas can be discharged from the end of the heat insulator 70 to the external space. Specifically, when the entire circumference of the side surface of the cylindrical target object 80 is covered, a space between the end of the insulator 70 and the target object 80 in an axial direction serves as the air supply port 71. Further, a space between the other end of the insulator 70 and the target object 80 in the axial direction serves as the exhaust port 72.

One end of the supply pipe 30 is connected to the supply device 20. The supply device 20 supplies gas and a coolant powder 41 to the supply pipe 30. The supply device 20 specifically includes a crusher 21 and an air cooler 22.

The air cooler 22 is connected to the compressed gas supply device 10. The compressed gas supply device 10 is, for example, a compressor or a gas cylinder and supplies dry compressed gas to the air cooler 22. The air cooler 22 cools the dry compressed gas and jets the same into the supply pipe 30. Note that air is used as the compressed air. Therefore, the air cooler 22 jets a low-temperature dry air 25 into the supply pipe 30. Obviously, the air cooler 22 may jet gas other than air such as nitrogen.

When a flow rate of the air 25 is low, the cooling capability could be insufficient. Therefore, the air cooler 22 preferably jets the air 25 at the flow rate of, for example, 100 l/min or more. On the other hand, when the flow rate of the air 25 is high, the coolant powder could be discharged from the exhaust port 72 without being sublimated. Therefore, the flow rate of the low temperature air 25 from the air cooler 22 is preferably 100 to 300 l/min. Obviously, the flow rate of the air 25 can be changed as appropriate according to the supply amount of the coolant powder 41, the size (i.e., the interval) of the space 81, the size (i.e., the diameter) of the supply pipe 30, and so on.

Specifically, the pressure and the supply amount of the compressed dry air of the compressed gas supply device 10 are 0.7 MPa and, 800 l/min, respectively. Then, the air cooler 22 supplies the cooled air 25 to the supply pipe 30 at 200 l/min and discharges the heated air at 600 l/min. Alternatively, the pressure and the supply amount of the compressed dry air of the compressed gas supply device 10 are defined as 0.7 MPa, 600 l/min, respectively. Then, the air cooler 22 supplies the cooled air 25 to the supply pipe 30 at 150 l/min, and discharges the heated air at 450 l/min.

The crusher 21 includes a pair of crushing rollers and the like. A sublimable coolant 40 is supplied to the crusher 21. The coolant 40 is, for example, dry ice (solid carbon dioxide). The coolant 40 supplied to the crusher 21 is crushed therein to become the coolant powder 41. That is, the crushing rollers rotate to crush the coolant 40 and the crushed coolant 40 falls down as the coolant powder 41. Then, the coolant powder 41 is supplied to the supply pipe 30. For example, the coolant 40 is supplied to the crusher 21 at 110 g/min.

As described above, the crusher 21 serves as a coolant supply part for supplying a sublimable coolant powder 41 to the supply pipe 30. A particle diameter of the coolant powder 41 is preferably equal to or smaller than 0.3 mm. The crusher 21 crushes the coolant 40 to produce the coolant powder 41 the particle diameter of which is 0 to 0.3 mm. In this manner, the coolant powder 41 can be prevented from remaining in the supply pipe 30.

Note that the crusher 21 supplies the coolant powder 41 to the supply pipe 30 between the air cooler 22 and the air supply port 71. Therefore, both the air 25 jetted from the air cooler 22 and the coolant powder 41 flow through the supply pipe 30. That is, the coolant powder 41 is forcibly transferred through the supply pipe 30 by the air 25.

As shown in FIG. 1, the coolant powder flowing through the supply pipe 30 with the air 25 is defined as a coolant powder 42. The coolant powder 42 is forced to flow through the supply pipe 30 by the air 25 and reaches the air supply port 71. In this manner, the air cooler 22 serves as a first gas jetting unit that jets the air 25 into the supply pipe 30 so that the coolant powder 42 flows through the supply pipe 30. The heat insulation hose is used as the supply pipe 30 and the air cooler 22 jets the low-temperature air 25. Therefore, the coolant powder 42 can be prevented from sublimating in the middle of the supply pipe 30.

As described above, the freezing box 50 is connected to the other end of the supply pipe 30. That is, the freezing box 50 is installed between the supply pipe 30 and the air supply port 71. The freezing box 50 is, for example, a box made of stainless steel. The air cooler 51 is installed in the freezing box 50. Similarly to the air cooler 22, a compressed dry gas such as air is supplied to the air cooler 51. For example, the compressed gas supply device 10 may supply the compressed air to the air cooler 51. Note that the freezing box 50 may be covered with an insulator such as a heat insulation sheet or the like.

The air cooler 51 cools the air and jets the cooled air to the freezing box 50. Accordingly, a low-temperature dry air 53 is jetted from the air cooler 51. Obviously, the air cooler 51 may jet gas other than air such as nitrogen. The coolant powder 42 is blown onto the target object 80 by the dry air 53. As shown in FIG. 1, the coolant powder blown onto the target object 80 is defined as being a coolant powder 43.

In the freezing box 50, the coolant powder 43 is diffused by the convection of the air 53 from the air cooler 51. The air cooler 51 serves as a second gas jetting unit that jets gas so that the coolant powder 43 from the supply pipe 30 is diffused. Therefore, the coolant powder 43 is blown onto the target object 80 while being diffused. The coolant powder 43 is sublimated when it is blown onto the high-temperature target object 80. The target object 80 is cooled by the latent heat of sublimation of the coolant powder 43. That is, the target object 80 is cooled by heat absorption which occurs when the coolant powder 43 is sublimated to gas.

Further, both the coolant powder 43 which is not sublimated and air 54 are sent into the space 81 between the heat insulator 70 and the target object 80. As shown in FIG. 1, the coolant powder 43 sent into the space 81 is defined as being a coolant powder 44. Both the coolant powder 44 and the air 54 flow through the space 81. When the coolant powder 44 flows through the space 81, the target object 80 is cooled by the latent heat of sublimation or vaporization. That is, the target object 80 is cooled by heat absorption which occurs when the coolant powder 44 is vaporized or sublimated.

Figure 2:
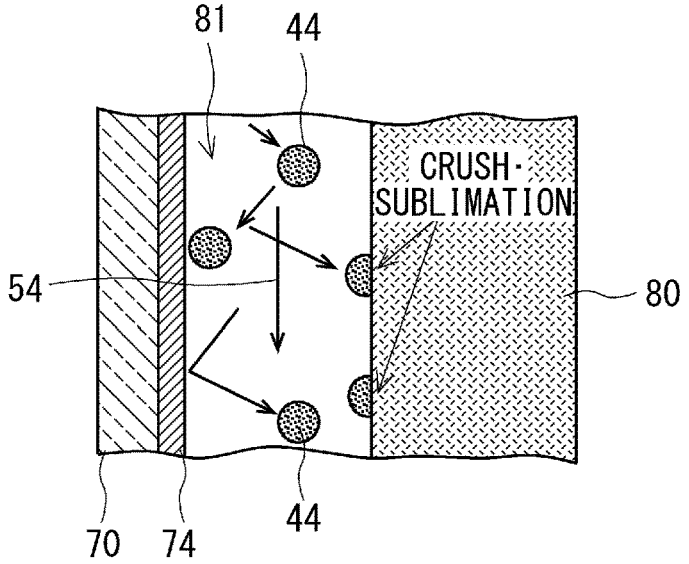
FIG. 2 is an enlarged schematic diagram showing a space between a heat insulation sheet and a target object.

The above-described matter is described with reference to FIG. 2. FIG. 2 is an enlarged schematic diagram showing the space 81 between the heat insulation sheet 70 and the target object 80 and the surroundings thereof. A metal plate 74 is disposed on the side of the target object 80 where the heat insulator 70 is located. That is, the metal plate 74 is disposed inside the heat insulator 70. The metal plate 74 is, for example, a metal sheet made of stainless steel. The metal plate 74 is preferably flexible like the heat insulator 70. Thus, the metal plate 74 and the heat insulator 70 can be disposed according to the shape of the target object 80. Further, an air layer may be provided between the metal plate 74 and the heat insulator 70. In this manner, heat insulation performance can be further improved.

For example, a fiber sheet such as an aramid fiber can be used as the heat insulator 70. Further, the heat insulator 70 may be a fiber sheet coated with a silicone resin or the like on one side or both sides. The heat insulator 70 can be made of any material with heat resistance according to an ambient temperature and a cooling temperature. For example, the heat-resistant temperature of the heat insulator 70 is in the range of −60° C. to +200° C. Further, when a flexible insulation sheet is used as the heat insulator 70, the shape thereof can be changed according to that of the target object 80.

Both the coolant powder 44 and the air 54 flow through the space 81 between the metal plate 74 and the target object 80. The coolant powder 44 repeatedly collides with the target object 80. Therefore, the coolant powder 44 spreads all around the space 81 to cool the target object 80. That is, the coolant powder 44 collides with the target object 80 to be sublimated. In this manner, the entire target object 80 can be cooled. Therefore, as indicated by the outline arrow shown in FIG. 1, the air 54 is discharged to the outside of the space 81 from the exhaust port 72 provided in the heat insulator 70.

Note that a spacer 89 can be disposed between the target object 80 and the heat insulator 70 as shown in FIG. 1 so that the size of the space 81 between the target object 80 and the heat insulator 70 becomes appropriate. The spacer 89 can be used to adjust the size of the space 81 between the heat insulator 70 and the target object 80 to approximately 10 mm to 100 mm. The spacer 89 preferably has heat insulation. The space 89 is, for example, a heat insulation rubber. A plurality of spacers 89 are distributed in the space 81. In this manner, the size of the space 81 can be made appropriate. When one or more spacers 89 are disposed in the space 81, the heat insulator 70 and the target object 80 can be prevented from coming into contact with each other. Thus, the size of the space 81 can be appropriately secured. The coolant powder 44 and the air 54 can flow all over the space 81 to improve the cooling performance. Note that as shown in FIG. 2, when the metal plate 74 is disposed on the side of the target object 80 of the heat insulator 70, the spacer 89 is disposed between the metal plate 74 and the target object 80.

When a flow rate of the air 53 from the air cooler 51 is low, the cooling capability could be insufficient. The air cooler 51 preferably jets the air 53 at the flow rate of, for example, 100 l/min or more. On the other hand, when the flow rate of the air 53 is high, the coolant powder 41 could be discharged without being sublimated. Therefore, the flow rate of the low temperature air 53 from the air cooler 51 is preferably 100 to 300 l/min. Obviously, the flow rate of the air 53 can be changed as appropriate according to the supply amount of the coolant powder 41, the size of the space 81, and so on. Note that the pressure and the flow rate of the compressed dry air supplied to the air cooler 51 and the flow rate of the air 53 supplied from the air cooler 51 can be made equal to those of the air cooler 22.

Figure 3:
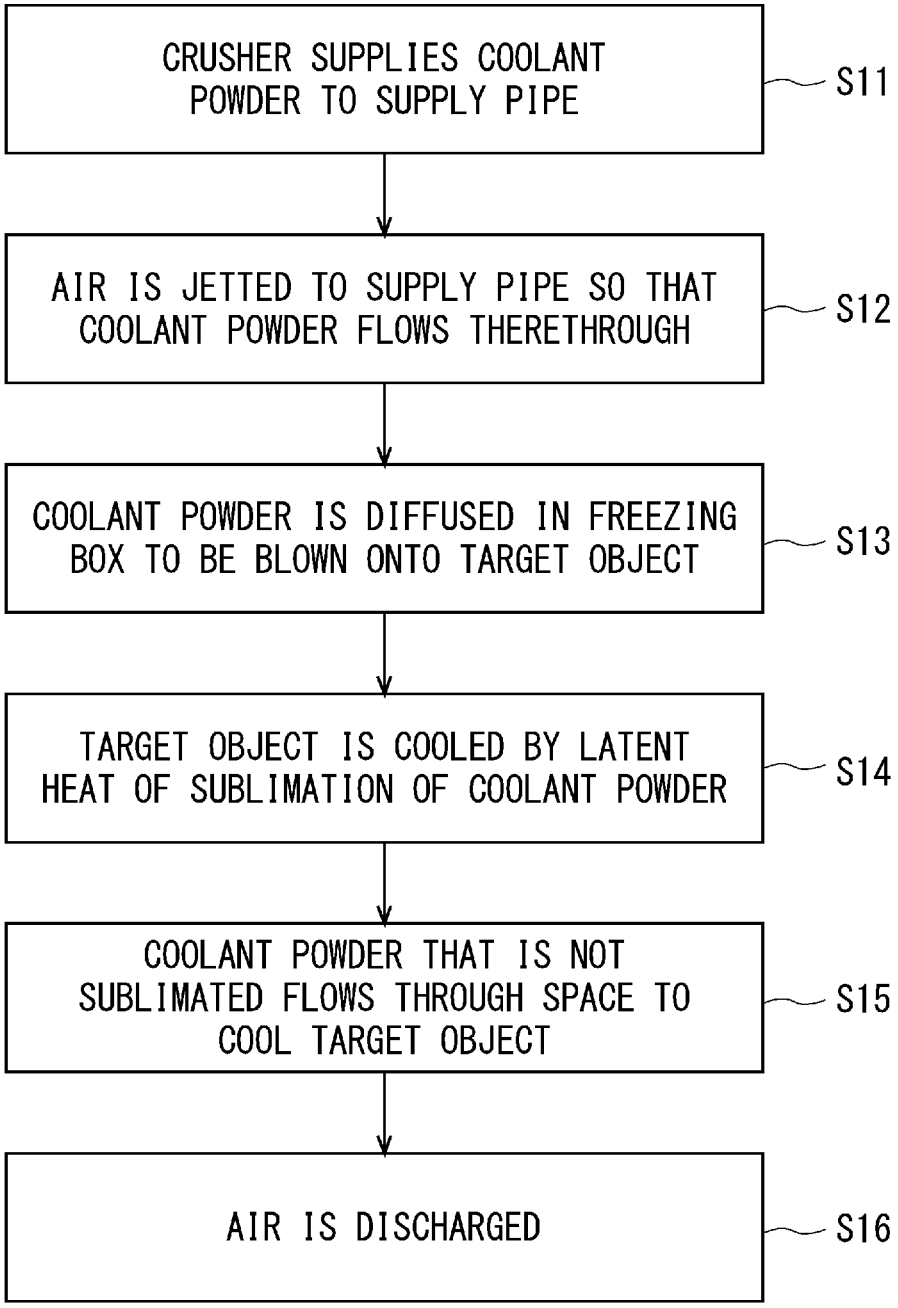
FIG. 3 is a flowchart showing a cooling method according to the first embodiment.

Next, a cooling method according to this embodiment is described with reference to FIGS. 1 and 3. FIG. 3 is a flowchart showing the cooling method. First, the crusher 21 supplies the coolant powder 41 to the supply pipe 30 (S11). For example, the crusher 21 crushes the coolant 40 into powder and supplies the coolant powder 41 to the supply pipe 30. Next, the air cooler 22 jets the low temperature air 25 into the supply pipe 30 so that the coolant powder 42 flows therethrough (S12). In this manner, the coolant powder 42 is sent out to the freezing box 50.

In the freezing box 50, the coolant powder 43 diffuses to be blown onto the target object 80 (S13). Specifically, the air cooler 51 jets the air 53 into the freezing box 50. Thus, the coolant powder 43 is blown onto the target object 80 by air convection caused by the air 53. Then, the target object 80 is cooled by the latent heat of sublimation of the coolant powder 43 (S14).

Further, the coolant powder 44 which is not sublimated flows through the space 81 to cool the target object 80 (S15). Since both the coolant powder 44 and the air 54 flow through the space 81, the coolant powder 44 repeatedly collides with the target object 80. The target object 80 is cooled by the latent heat of sublimation of the coolant powder 44. In this manner, the target object 80 can be cooled thoroughly. Then, the air 54 is discharged to the outside of the space 81 from the exhaust port 72 (S16).

According to this embodiment, a cooling apparatus 100 which has a higher-performance, is more space-saving, and costs less than the cooling apparatus disclosed in Japanese Unexamined Patent Application Publication No. 2009-216357 can be achieved. For example, the coolant powder 43 is supplied to the space 81 between the insulator 70 and the target object 80. Therefore, a thermostatic bath for accommodating the target object 80 is not necessary since at least a part of the target object 80 may be merely covered with the insulator 70. No large refrigerator is needed even when cooling at high speed. Thus, a space-saving and low-cost cooling apparatus 100 can be achieved. The target object 80 is covered with the insulator 70. Then, the coolant powder 44 collides with the target object 80 to absorb the heat of the target object 80. Therefore, the cooling performance can be improved. Accordingly, the cooling can be performed to reach a target temperature in a short time.

The coolant powder 41 is supplied to the supply pipe 30. Therefore, the latent heat of the coolant can be used efficiently. Further, when the coolant 40 the particle diameter of which is large is supplied to the supply pipe 30, it could be discharged without being sublimated. Thus, the powdered coolant is preferably supplied to the supply pipe 30. The particle diameter of the coolant powder 41 is preferably equal to or smaller than 0.3 μm. Further, the supply pipe 30 preferably is a heat insulation pipe such as a heat insulation hose in order to prevent sublimation occurring in the middle of the supply pipe 30. When a heat insulation flexible hose is used as the supply pipe 30, it can be easily attached to the freezing box 50 or the like.

Further, in this embodiment, the coolant powder 41 is forced to flow through the supply pipe 30 by the dry air 25. In this manner, moisture in the air can be prevented from freezing in the middle of the supply pipe 30. Since clogging of the supply pipe 30 with the frozen moisture can be prevented, the coolant powder 42 can be sent out to the space 81. Further, the air 25 cooled by the air cooler 22 forces the coolant powder 41 to reach the air supply port 71. In this manner, it is possible to prevent sublimation occurring in the middle of the supply pipe 30 and cool the target object 80 efficiently.

Further, in this embodiment, the supply pipe 30 and the exhaust port 71 are connected with each other through the freezing box 50. Then, the air cooler 51 is connected to the freezing box 50. The air cooler 51 jets the air 53 toward the air supply port 71. Thus, the coolant powder 43 can be spread around the target object 80 by the coolant powder 43 being sent by the air convection caused by the air cooler 51. Therefore, the target object 80 can be cooled efficiently.

Example 1

Figure 4:
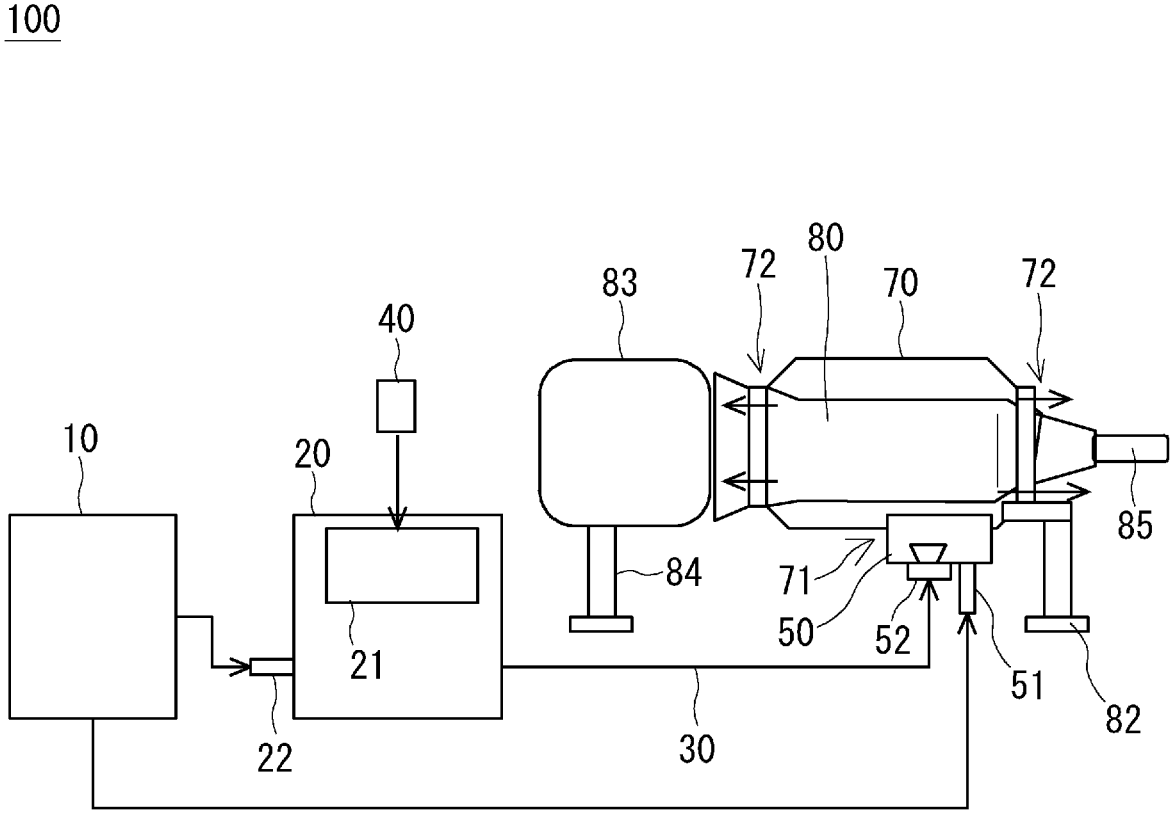
FIG. 4 is a schematic diagram showing a configuration of a cooling apparatus according to an example 1.

A cooling apparatus 100 according to an example 1 is described with reference to FIG. 4. FIG. 4 is a schematic diagram showing the overall configuration of the cooling apparatus 100. In the example 1, a transmission (T/M) of an automobile engine is used as the target object 80. Note that the descriptions common to those of the first embodiment will be omitted as appropriate. Further, in FIG. 4, a part of the configuration shown in FIG. 1 is simplified.

The target object 80 is disposed on a stand 82. Further, the transmission used as the target object 80 is connected to an engine 83. The engine 83 is disposed on a stand 84. Further, the target object 80 is connected to a power transmission joint 85. For example, the cooling apparatus 100 cools the target object 80 in order to perform a low-temperature operation test for the transmission (the target object 80). Specifically, the test is performed while operating the engine 83. That is, power generated by the engine is transmitted to the power transmission joint 85 through the target object 80. Then, the power transmitted to the power transmission joint 85 is monitored in the low-temperature operation.

The target object 80 is covered with the heat insulator 70. Similarly to the first embodiment, the compressed gas supply device 10 supplies the compressed air to the air cooler 22. The air cooler 22 cools the air and jets the cooled air. The crusher 21 crushes the coolant into powder and supplies the coolant powder to the supply pipe 30. Then, the coolant powder is forced to flow through the supply pipe 30 by the low temperature air jetted from the air cooler 22. The coolant powder is then sent into the freezing box 50.

The freezing box 50 is attached to the exhaust port 71 of the heat insulator 70. The air cooler 51 is connected to the freezing box 50. The compressed air is supplied to the air cooler 51. Then, the air that flowed through the space between the target object 80 and the heat insulator 70 is discharged from the exhaust port 72.

In the example 1, the heat insulator 70 is disposed near the engine 83 in operation. The heat insulator 70 is preferably made of materials with heat resistance under high-temperature environment. This is because the heat insulator 70 is heated by the high-temperature engine 83. Accordingly, in the example 1, the upper limit of the heat resistance temperature of the heat insulator 70 is 500° C.

Further, in the example 1, a spray nozzle 52 is attached to an end of the supply pipe 30. The spray nozzle 52 jets the coolant powder to the target object 80. Note that the diameter of the supply pipe 30 is enlarged to form the spray nozzle 52. For example, the supply pipe 30 of diameter of 16 mm is enlarged in a part of the supply pipe 30 immediately in front of the freezing box 50 to 20 mm. In this manner, the spray nozzle 52 can diffuse the coolant powder.

Figure 5:
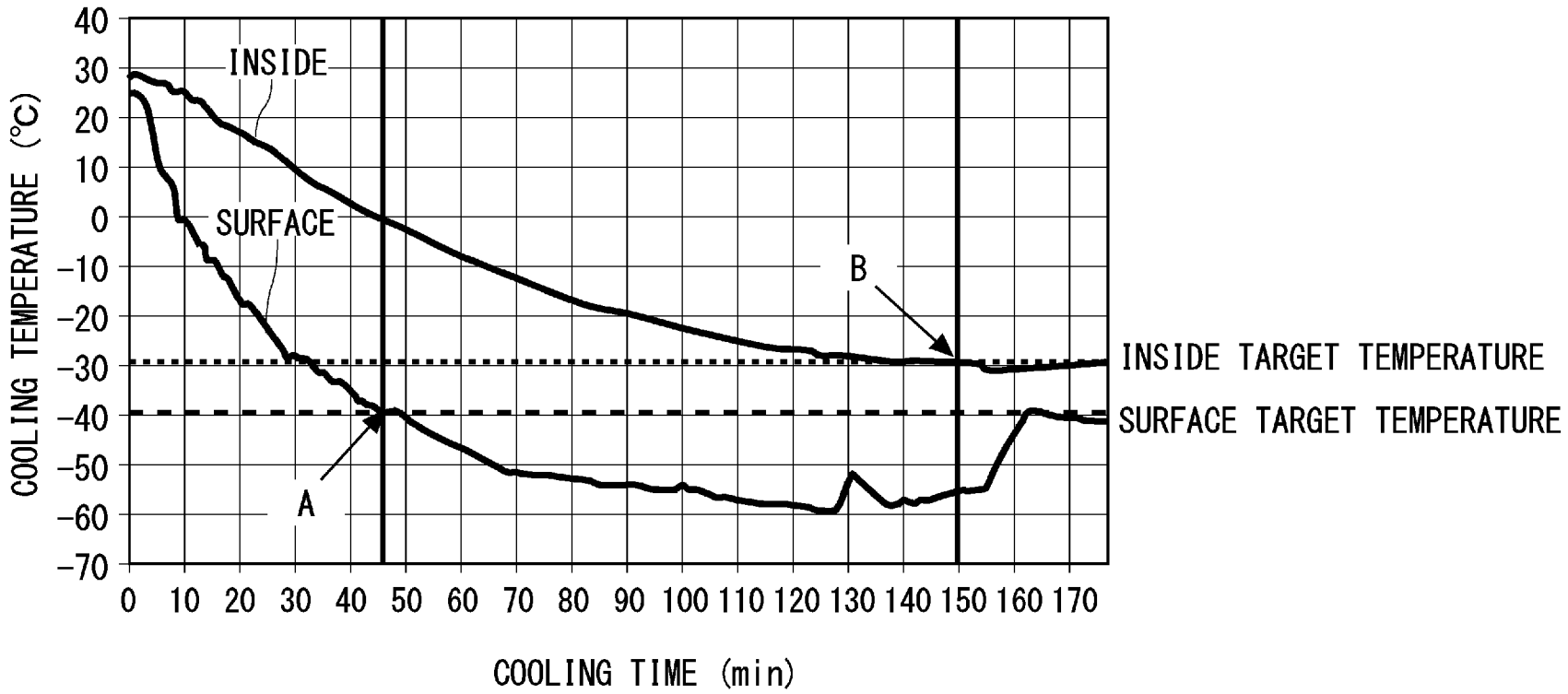
FIG. 5 is a graph showing a cooling temperature with the cooling apparatus according to the example 1.

FIG. 5 is a graph showing a result of measurement of a temperature cooled by the cooling apparatus 100 according to the example 1. Note that FIG. 5 is a graph showing a change between the oil temperature of the surface of the transmission (the target object 80) and that of the inside thereof with time. The horizontal axis shows the cooling time and the vertical axis shows the oil temperature. As indicated by an arrow A in FIG. 5, the temperature of the surface of the transmission reaches −40° C., which is the target temperature, in about 45 minutes after the start of cooling. Further, as indicated by an arrow B in FIG. 5, the temperature of the inside of the transmission reaches −30° C., which is the target temperature, about two and a half hours after the start of cooling. Accordingly, with the configuration of the example 1, the target object can be cooled to the target temperature within three hours after the start of cooling.

Example 2

Figure 6:
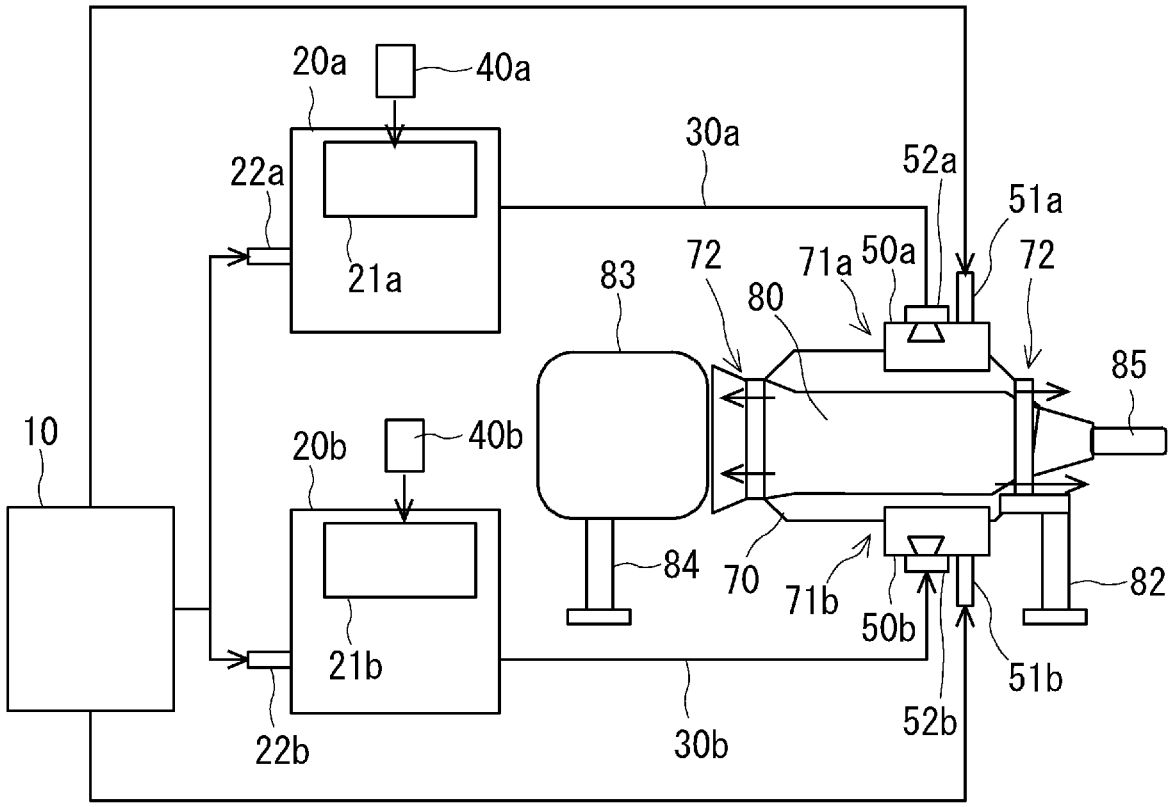
FIG. 6 is a schematic diagram showing a configuration of the cooling apparatus according to an example 2.

A cooling apparatus 100 according to an example 2 is described with reference to FIG. 6. FIG. 6 is a schematic diagram showing a configuration of the cooling apparatus 100. In this example, the supply devices are provided in parallel. In FIG. 6, two supply devices provided in the cooling apparatus 100 are respectively shown as the supply device 20*a* and the supply device 20*b*. In FIG. 6, "a" is assigned to the reference numbers of the components relating to the supply device 20*a*, and "b" is assigned to the reference numbers of the components relating to the supply device 20*b*. The configuration, except that the supply devices 20*a* and 20*b* are provided in parallel, is the same as that of the first embodiment and the example 1, and the explanation is thus omitted.

The supply device 20*a* includes a crusher 21*a* and an air cooler 22*a*. The supply device 20*a* is connected to a supply pipe 30*a*. Therefore, the supply device 20*a* supplies the cooled air and the coolant powder to the supply pipe 30*a*.

The supply device 20*b* includes a crusher 21*b* and an air cooler 22*b*. The supply device 20*b* is connected to a supply pipe 30*b*. Therefore, the supply device 20*b* supplies the cooled air and the coolant powder to the supply pipe 30*b*.

Note that in FIG. 6, the compressed air from one compressed gas supply device 10 is supplied to two air coolers 22*a* and 22*b*. Obviously, two compressed gas supply devices 10 may be prepared to respectively supply the compressed air to the air coolers 22*a* and 22*b*.

The coolant powder is forcibly transferred by air in the supply pipes 30*a* and 30*b*. Two air supply parts 71*a* and 71*b* are provided in the heat insulator 70. The supply pipe 30*a* is connected to the air supply port 71*a* through a freezing box 50*a*. The supply pipe 30*b* is connected to the air supply port 71*b* through a freezing box 50*b*.

In this configuration, the coolant powder is supplied from two spots and thus the cooling performance can be improved. In FIG. 6, two sets of the supply devices 20 and the supply pipes 30, etc. are provided. However, three or more sets of them can be provided.

Example 3

Figure 7:
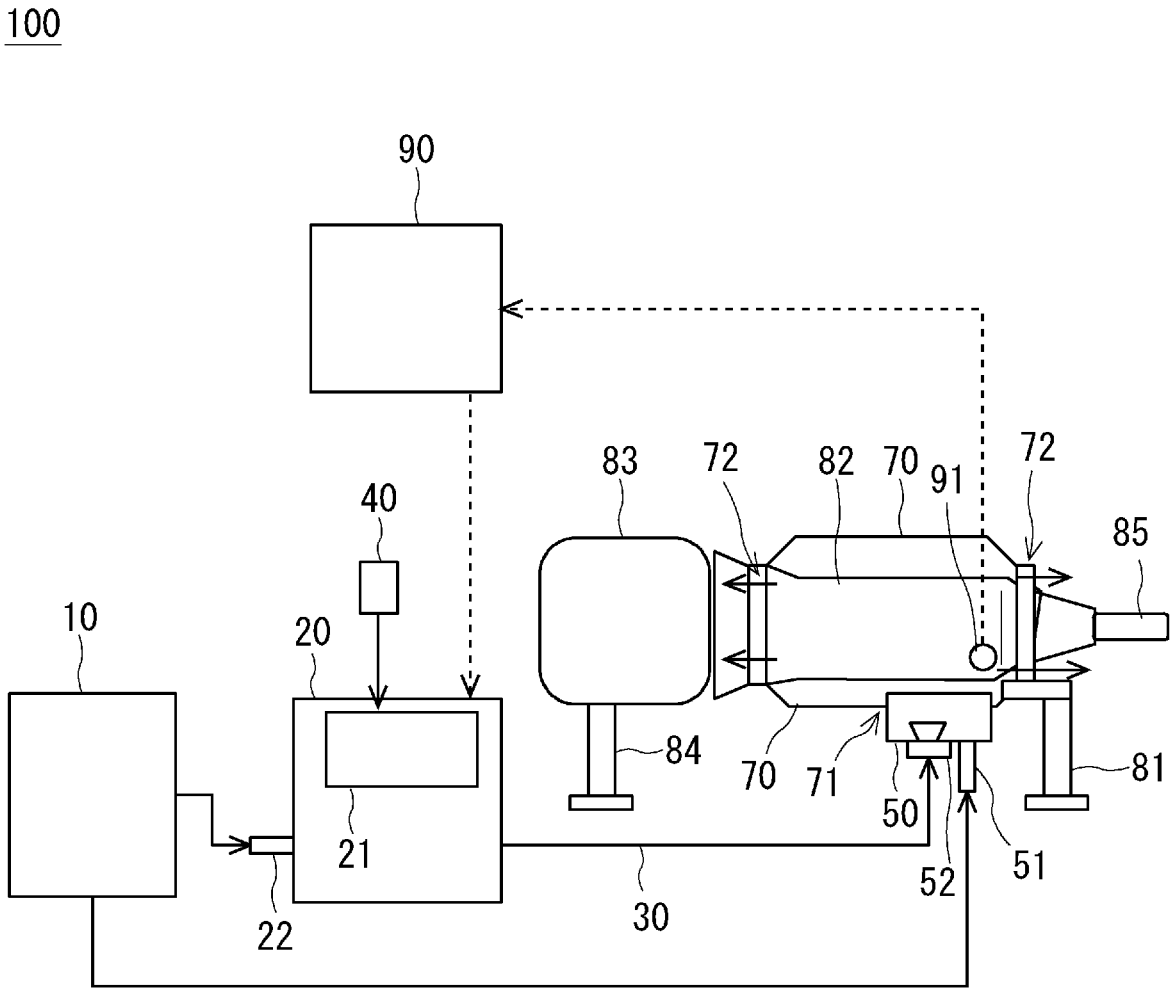
FIG. 7 is a schematic diagram showing a configuration of the cooling apparatus according to an example 3.

A cooling apparatus 100 according to an example 3 is described with reference to FIG. 7. FIG. 7 is a schematic diagram showing a configuration of the cooling apparatus 100. In this example, a temperature sensor 91 and a control unit 90 are added to the example 1. The configuration except for the addition of the temperature sensor 91 and the control unit 90 is the same as that of the first embodiment and the example 1, the explanation is thus omitted as appropriate.

The temperature sensor 91 is attached to the target object 80 and measures the temperature of the target object 80. The temperature sensor 91 outputs the detected temperature information to the control unit 90. The control unit 90 controls the cooling power based on the temperature information. For example, the control unit 90 adjusts the amount of the coolant powder to be supplied to the crusher 21.

When the detected temperature is much lower than the target temperature, the control unit 90 reduces the amount of the coolant. In contrast to this, when the detected temperature is much higher than the target temperature, the control unit 90 increases the amount of the coolant. Alternatively, the control unit 90 may control the temperature by changing the flow rate of the compressed air to be supplied to the air cooler 22 or the air cooler 51. The control unit 90 can control the temperature by adjusting the supply amount of at least one of the coolant or the air.

As describe above, the control unit 90 can feedback-control based on the temperature detected by the temperature sensor 91. Accordingly, the test can be performed with the target object 80 having a desired temperature. Further, the test can be performed while changing the temperature. That is, the target temperature may be changed with time. In this manner, the test can be performed while changing the temperature of the target object 80 with time.

A combination of two or more of the above-described first embodiment and the examples 1 to 3 can be used. For example, in a configuration in which a temperature is controlled in a manner as described in the example 3, two or more sets of the supply devices 20 can be provided like in the example 2.

Note that the present disclosure is not limited to the above described embodiment and various modifications can be made without departing from the spirit of the present disclosure.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A cooling apparatus, comprising:

a heat insulator covering at least a part of a target object;

a supply pipe connected to a space between the heat insulator and the target object;

a coolant supply unit configured to supply a sublimable coolant powder to the supply pipe; and a first gas jetting unit configured to jet gas to the supply pipe so that the coolant powder flows through the supply pipe.

2. The cooling apparatus according to claim 1, further comprising a second gas jetting unit configured to jet gas so as to diffuse the coolant powder from the supply pipe.

3. The cooling apparatus according to claim 2, wherein the space and the supply pipe are connected through a freezing box, and the second gas jetting unit cools gas to be jetted into the freezing box.

4. The cooling apparatus according to claim 1, wherein the first air jetting unit cools dry air to be jetted into the supply pipe.

5. The cooling apparatus according to claim 1, wherein the coolant supply unit crushes a coolant into powder and supplies the coolant powder to the supply pipe.

6. The cooling apparatus according to claim 1, wherein the heat insulator is a flexible heat insulation sheet.

7. The cooling apparatus according to claim 1, wherein a spacer is disposed between the heat insulator and the target object.

8. The cooling apparatus according to claim 1, wherein a metal plate is disposed on a side of the target object where the heat insulator is located so that the coolant powder flows through a space between the metal plate and the target object.

9. The cooling apparatus according to claim 1, wherein the supply pipe is a heat insulation hose.

10. A cooling method, comprising:

supplying a sublimable coolant powder to a supply pipe connected to a space between a heat insulator and a target object;

jetting gas into the supply pipe so that the coolant powder flows through the supply pipe;

cooling the target object by making the coolant powder flow through the space; and discharging the gas that has flowed through the space.

* * * * *